US006623297B2

(12) United States Patent
Hwang

(10) Patent No.: US 6,623,297 B2
(45) Date of Patent: Sep. 23, 2003

(54) GBIC ELECTRICAL CONNECTOR ASSEMBLY

(75) Inventor: Jenq-Yih Hwang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 4 days.

(21) Appl. No.: 09/947,180

(22) Filed: Sep. 4, 2001

(65) Prior Publication Data

US 2003/0045144 A1 Mar. 6, 2003

(51) Int. Cl.[7] ..... H01R 13/60; H01R 13/66; H01R 13/648

(52) U.S. Cl. ..... 439/541.5; 439/607

(58) Field of Search ..... 439/541.5, 607, 439/138, 76.1, 74, 64, 660, 701; 359/163; 361/722, 756

(56) References Cited

U.S. PATENT DOCUMENTS 5,722,861 A * 3/1998 Wetter ..... 29/884
6,113,428 A * 9/2000 Yeh ..... 439/609
6,146,195 A * 11/2000 Chang ..... 439/541.5
6,270,359 B1 * 8/2001 Kondo et al. ..... 439/76.2

* cited by examiner

*Primary Examiner*—Chandrika Prasad
(74) *Attorney, Agent, or Firm*—Wei Te Chung

(57) ABSTRACT

An electrical connector system (30) for transmitting electrical signals from a GBIC module inserted in a guide rail (10) mounted a distance above a printed circuit board (50) includes a substrate (70) having upper and lower surfaces (72, 74), a first connector (60) mounted on the upper surface of the substrate, and a second connector (80) mounted on the lower surface of the substrate and electrically connecting with the first connector. The substrate and the second connector together define a receiving space (90) for receiving another electrical element therein. The second connector comprises a base (82), a plurality of pins (84) secured to the base, an insulative extension (86), and a metal shell (88) enclosing the base. Each pin has a first end (842) connecting to the substrate and a second end (844) connecting to the printed circuit board.

14 Claims, 8 Drawing Sheets

GBIC ELECTRICAL CONNECTOR ASSEMBLY

BACKGROUND OF THE INVENTION

1. Field of the Invention

The present invention relates to an electrical connector assembly, and particularly to an electrical connector assembly used in a stacked gigabit interface converter (hereinafter, GBIC) module guide rail system in which two guide rails are stacked one above the other.

2. Description of Related Art

U.S. Pat. No. 5,879,173, issued to Poplawski et al on Mar. 9, 1999, discloses a receptacle or guide rail for receiving a removable optoelectronic module therein. FIGS. 10, 15, and 16 disclose a guide rail 372 having a box configuration, while FIGS. 14, 17 and 18 disclose another type of guide rail.

U.S. Pat. No. 5,767,999, issued to Kayner on Jun. 16, 1998, discloses another type of guide rail for receiving a removable optoelectronic module therein.

U.S. Pat. No. 6,047,172, issued to Babineau et al. on Apr. 4, 2000, suggests an arrangement in which guide rails can be arranged in two different levels (only one level is disclosed), as shown in FIG. 2. However, upper guide rails are mounted on an upper printed circuit board, while lower guide rails are mounted on a lower printed circuit board. Although Babineau et al. suggests the idea of arranging the guide rails in two different levels, the suggested implementation of this idea is not cost effective because two different printed circuit boards are required.

Accordingly, a guide rail system in which two guide rails can be stacked one above the other and mounted on the same printed circuit board is desired. A second, unresolved issue is how to transmit electrical signals from a GBIC module mounted in an upper guide rail of a stack of two guide rails to the printed circuit board some distance below the upper guide rail. Hence, an electrical connector assembly which can transmit electrical signals from a GBIC module in an upper guide rail to a printed circuit board is desired.

SUMMARY OF THE INVENTION

Accordingly, the object of the present invention is to provide an electrical connector assembly which can transmit electrical signals from a GBIC module mounted in an upper guide rail of a stack of two guide rails to a printed circuit board on which the guide rails are mounted.

In order to achieve the object set forth, an electrical connector assembly for transmitting electrical signals from a GBIC module mounted in a guide rail to a printed circuit board a distance below the guide rail comprises a substrate having upper and lower surfaces, a first connector mounted on the upper surface of the substrate, and a second connector mounted on the lower surface of the substrate and electrically connecting with the first connector. The substrate and the second connector together define a receiving space for receiving other electrical elements therein. The second connector comprises a base, a plurality of pins secured within the base, and a metal shell enclosing the base. Each pin has a first end mounted on the substrate and a second end for being mounted to the printed circuit board. Electrical signals can be transmitted from the GBIC module to the printed circuit board via the first connector, the substrate, and the second connector. Electrical signals can be transmitted from the GBIC module to the printed circuit board via the first connector, the substrate, and the second connector.

Other objects, advantages and novel features of the invention will become more apparent from the following detailed description when taken in conjunction with the accompanying drawings.

DETAILED DESCRIPTION OF THE INVENTION

Figure 1:
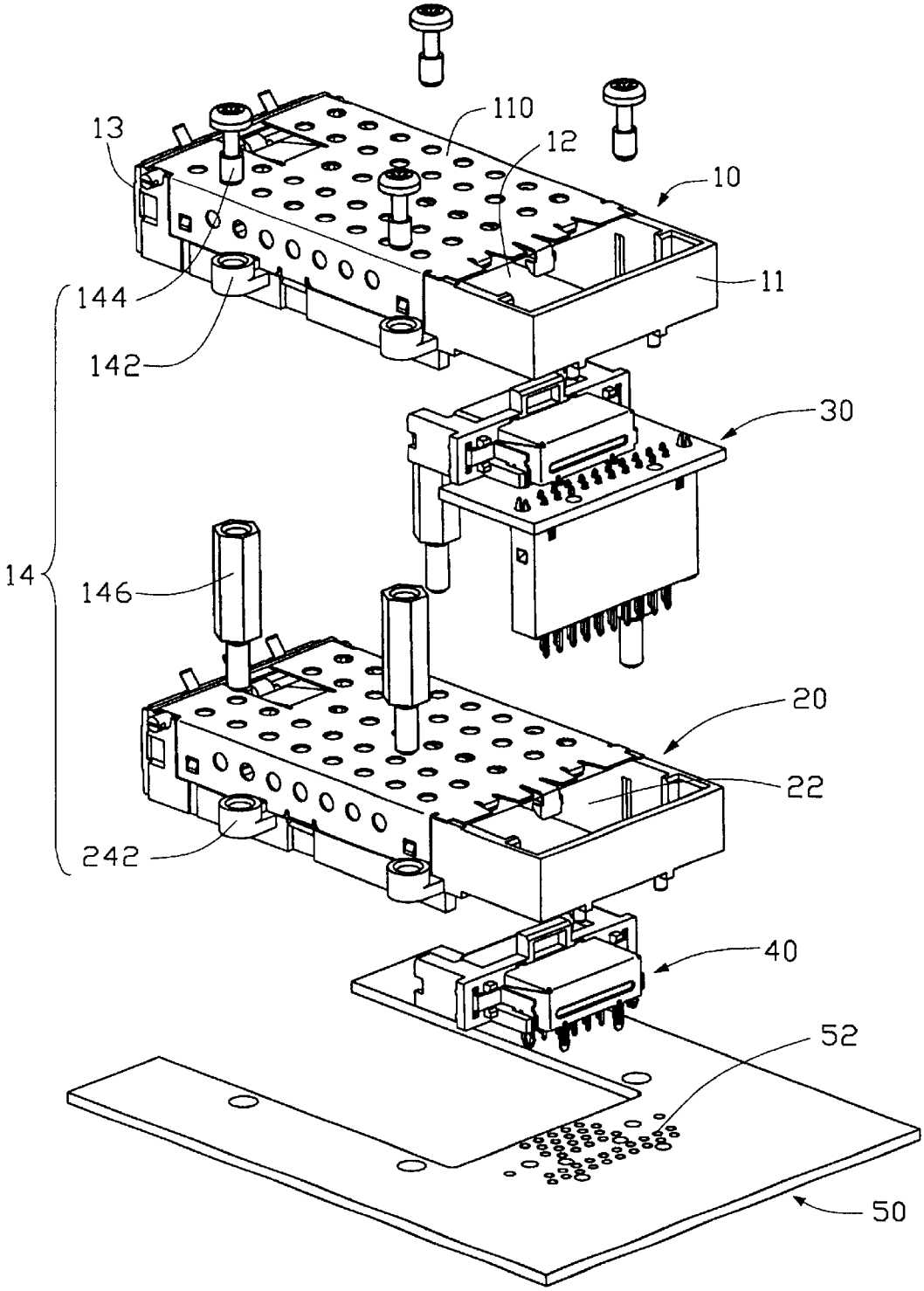
FIG. 1 is an exploded view of a stacked GBIC module system.

Referring to FIG. 1, a GBIC guide rail system comprises an upper guide rail 10 for receiving the first GBIC module (not shown) therein, a lower guide rail 20 for receiving a second GBIC module (not shown) therein, an electrical connector assembly 30 for electrically connecting with the first GBIC module, a lower connector 40 for electrically connecting with the second GBIC module, and a printed circuit board 50.

Figure 8:
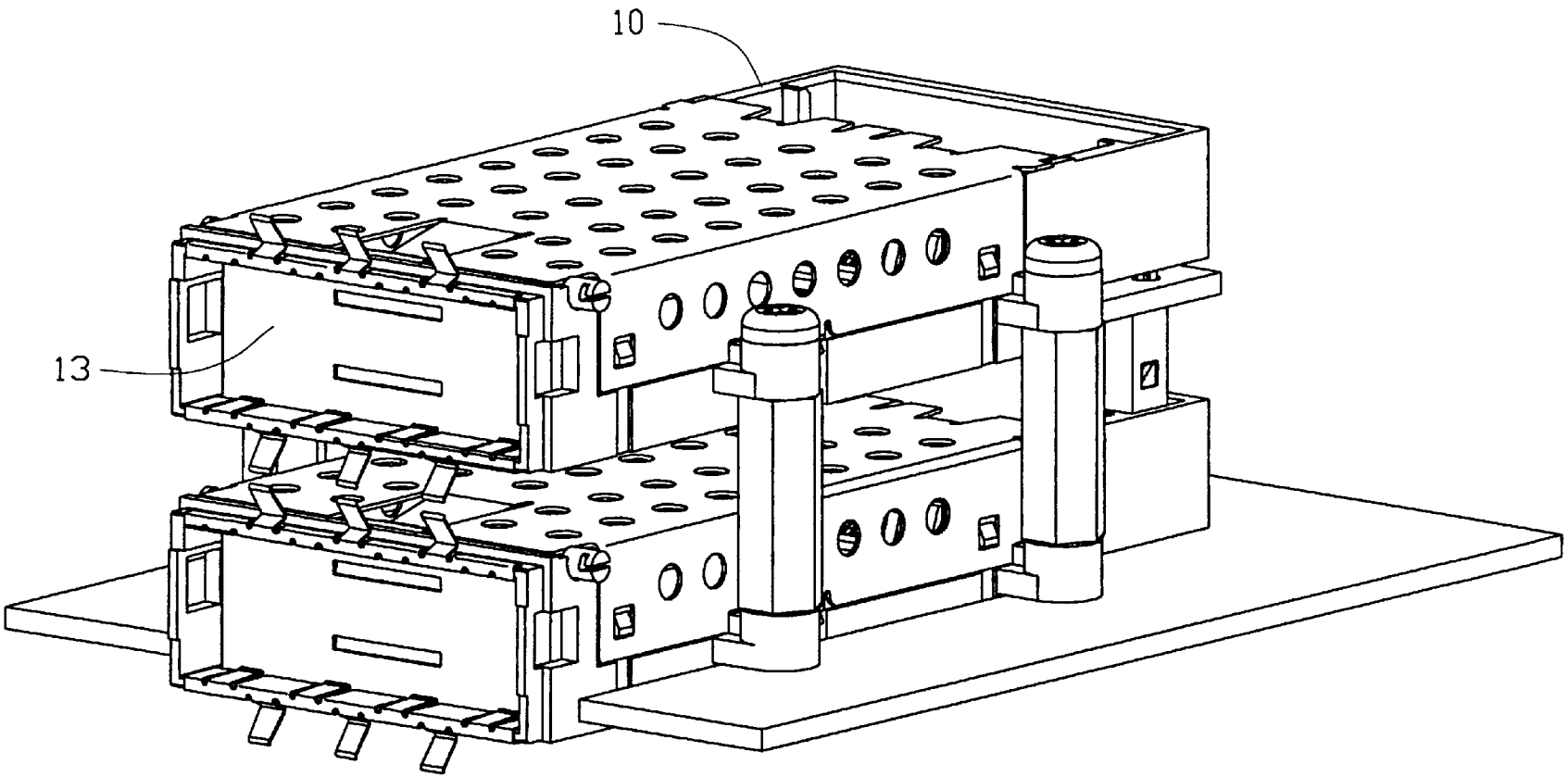
FIG. 8 is an assembled view of FIG. 1.

Referring to FIGS. 1 and 8, the upper guide rail 10 includes a first frame 11 defining a receiving space 12 for receiving the first GBIC module therein through a front port 13 thereof. The first frame 11 includes a metallic cover 110 attached to the first frame 11. Four first side lugs 142 are integrally formed on outer walls of the first frame 11. The lower guide rail 20 has a same structure as that of the upper guide rail 10. The printed circuit board 50 defines a plurality of through holes 52 therein. Four attaching devices 14 are included in the GBIC guide rail system. Each attaching device 14 comprises a first side lug 142, a second side lug 242, a bolt 144, and a fasten member 146.

Figure 2:
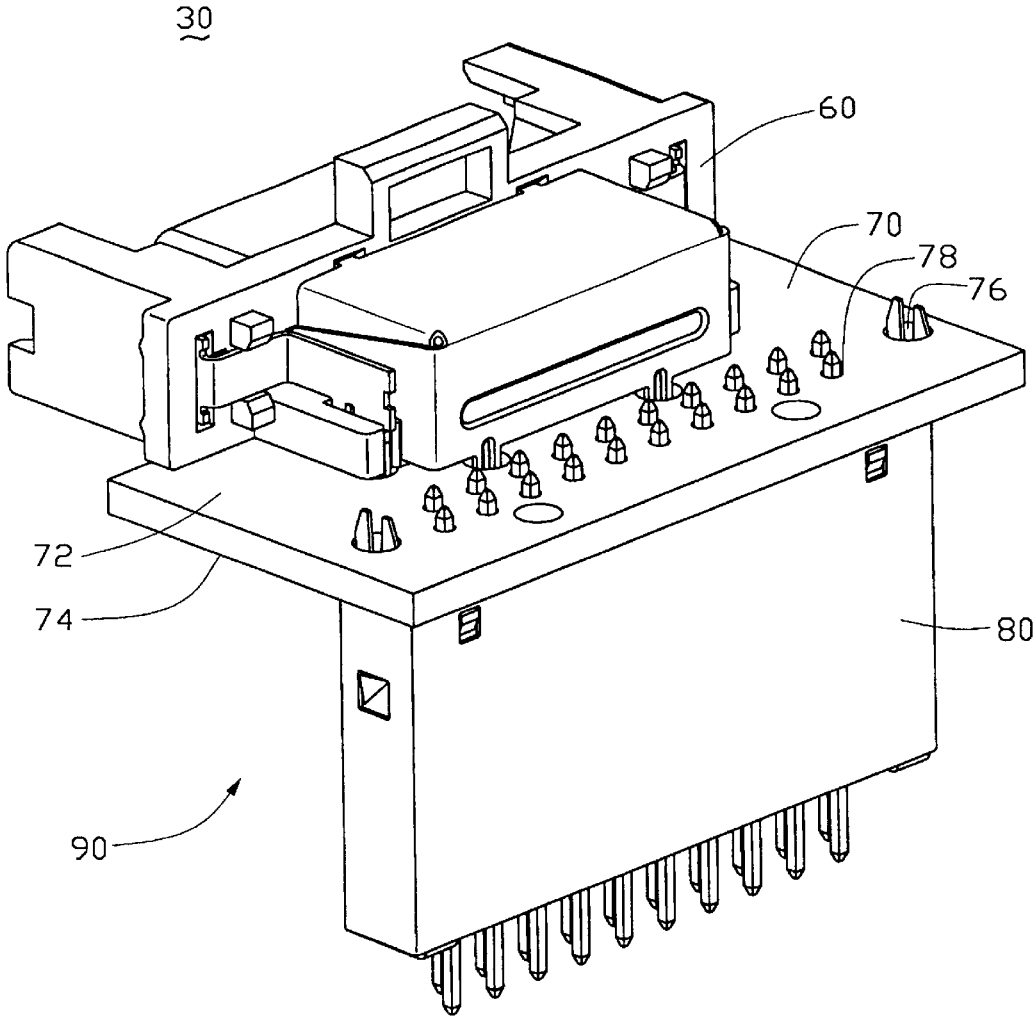
FIG. 2 is a perspective view of an electrical connector assembly for electrically connecting the upper GBIC module of FIG 1 to a printed circuit board.

Referring to FIG. 2, the electrical connector assembly 30 comprises a first connector 60, a substrate 70 having upper and lower surfaces 72 and 74, and a second connector 80. A receiving space 90 is defined by the substrate 70 and the second connector 80 for receiving the lower connector 40 therein. A group of first holes (not shown) is defined on one end of the substrate 70, a group of second holes 78 is defined on another end of the substrate 70, and a pair of enlarged holes 76 is defined on two sides of the substrate 70 adjacent to the group of second holes 78.

Figure 3:
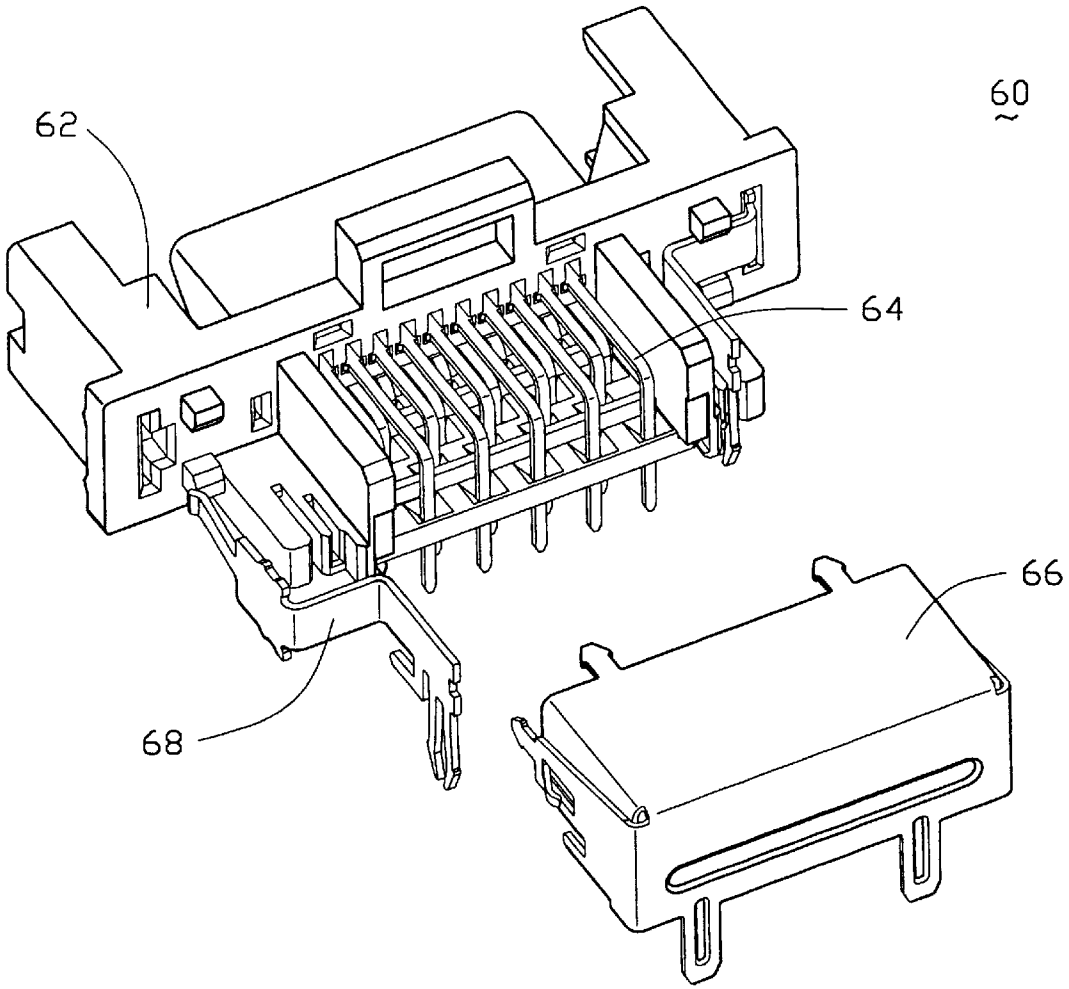
FIG. 3 is a partially exploded view of a first connector of the electrical connector assembly of FIG 2.

Referring to FIG. 3, the first connector 60 comprises a first housing 62, a plurality of first terminals 64 received in the first housing 62, a first shell 66 covering a rear end of the first housing 62, and a pair of grounding board locks 68 secured on two sides of the housing for mounting the first connector 60 to the substrate 70 and for connecting to corresponding grounding contacts of the inserted first GBIC module (not shown). The lower connector 40 has the same structure as that of the first connector 60.

Figure 4:
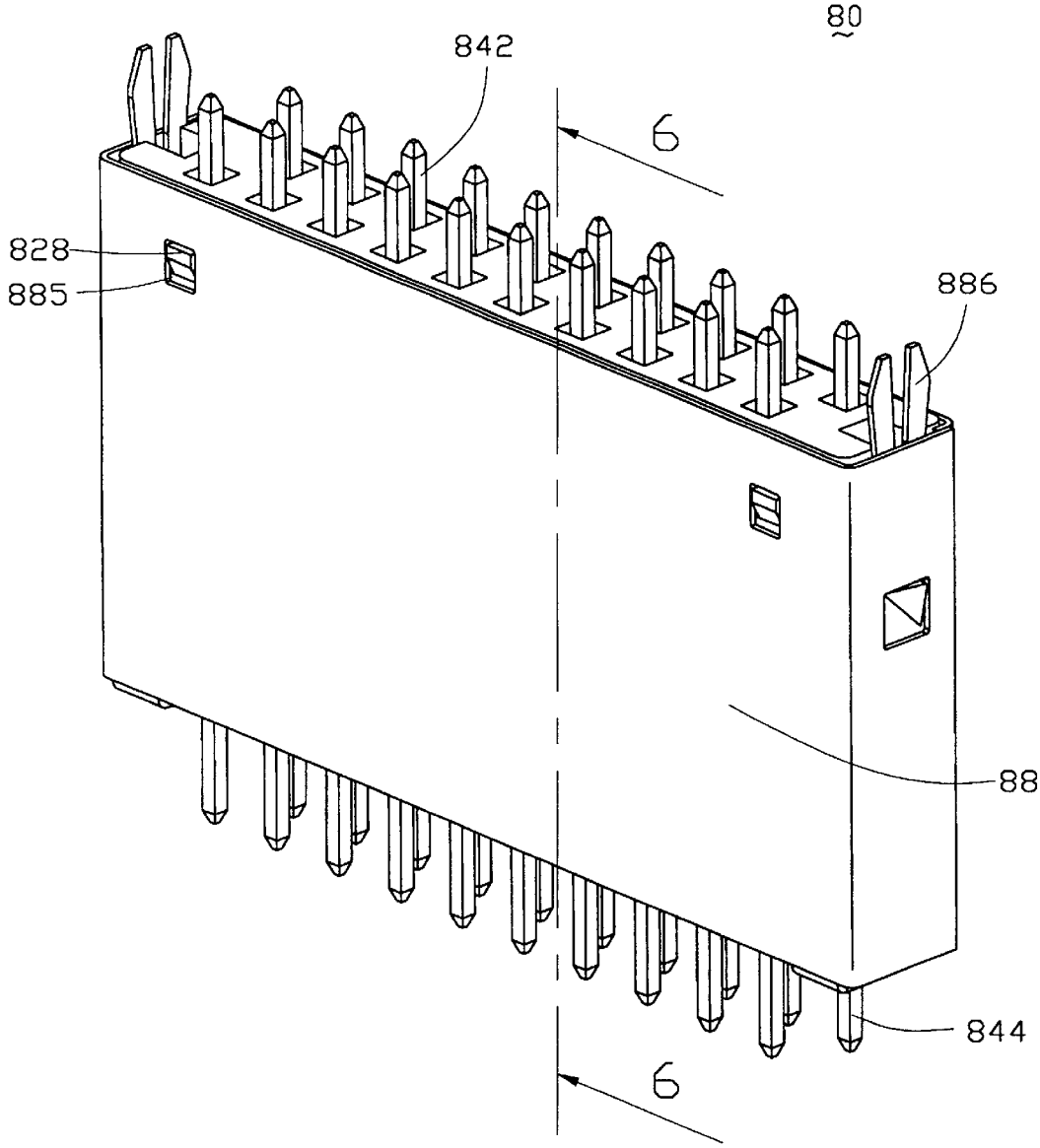
FIG. 4 is a perspective view of a second connector of the electrical connector assembly of FIG 2.
Figure 5:
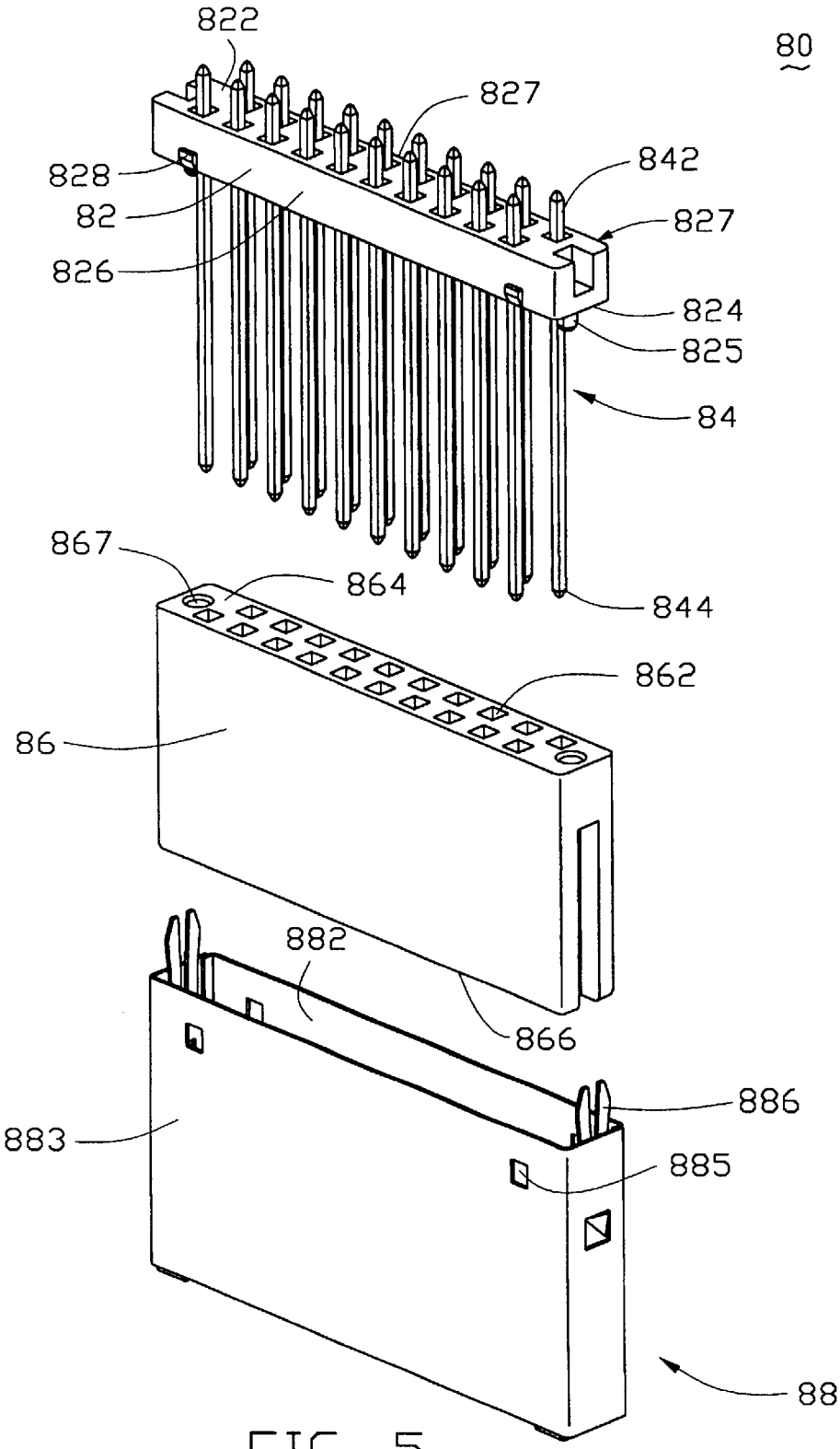
FIG. 5 is an exploded view of the second connector.

Referring to FIGS. 4 and 5, the second connector 80 has a base 82, a plurality of pins 84 insert molded with the base 82, an insulative extension 86, and a metal shell 88. The base 82 has an upper face 822, a lower face 824, a front face 826, and a rear face 827. A pair of posts 825 extends downwardly from the lower face 824. A pair of projections 828 is formed on each of the front and rear faces 826 and 827 of the base.

Each pin 84 has a first end 842 extending beyond the upper face 822 of the base 82 and a second end 844 extending beyond the lower face 824 of the base 82.

Figure 6:
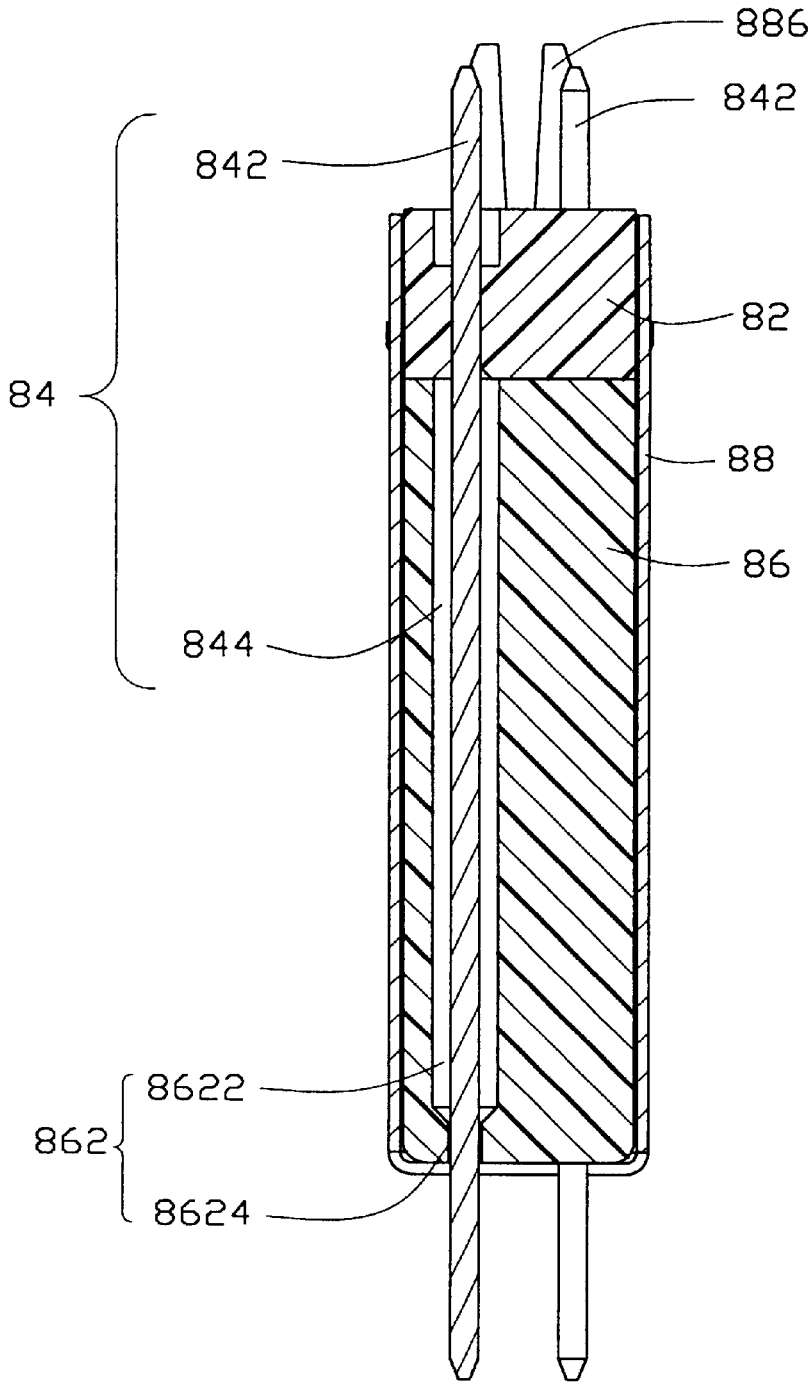
FIG. 6 is a cross-sectional view of the second connector taken along line 6—6 of FIG. 4.

Referring to FIGS. 5 and 6, the extension 86 defines a plurality of passageways 862 through an upper face 864 to a lower face 866 thereof. Each passageway 862 has a large portion 8622 opening to the upper face 864 and an outlet 8624 adjacent to the lower face 866. A cross section of the large portion 8622 of each passageway 862 is larger than a cross section of each pin 84. A pair of holes 867 is defined in the extension 86 from the upper face 864 to the lower face 866 adjacent a pair of sides thereof.

Figure 7:
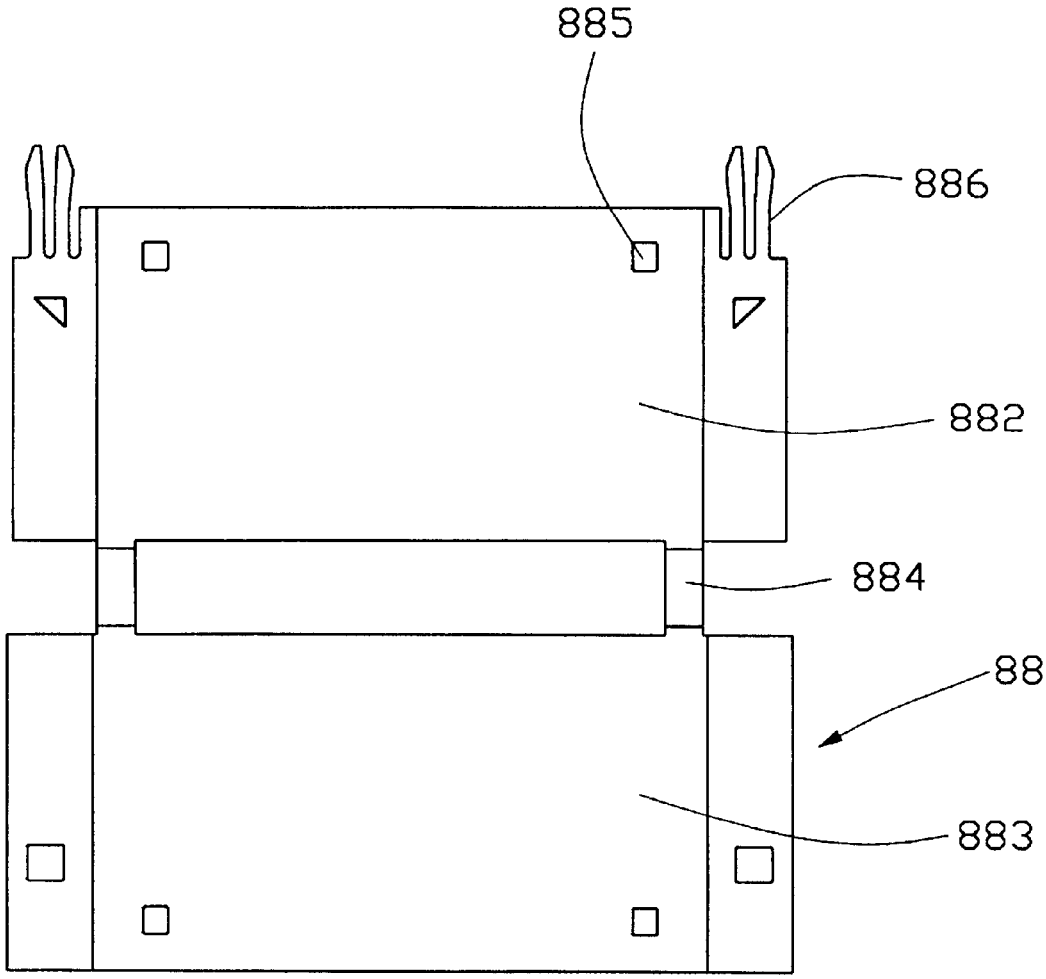
FIG. 7 is a plan view of an unfolded metal shell of the second connector of the electrical connector assembly.

Referring to FIGS. 5, 6 and 7, the metal shell 88 comprises a first part 882, a second part 883, and a pair of connection portions 884 connecting the first part 882 and the second part 883. A pair of windows 885 is separately defined in the first part 882 and in the second part 883 of the metal shell 88. A pair of board locks 886 extends upwardly from a pair of sides of the first part 882. The metal shell 88 is bent to form the shape shown in FIG. 5 for enclosing the base 82 and the extension 86 therein.

In assembly, referring to FIGS. 4, 5 and 6, the second ends 844 of the pins 84 extend through the passageways 862 of the extension 86 from the upper face 864 to the lower face 866 thereof with the posts 825 being fixed into the corresponding holes 867. In the large portion 8622 of each passageway 862, an airspace surrounds the second end 844 of each pin 84. The second end 844 is snugly fitted in the outlet 8624 of the passageway 862. The metal shell 88 encloses the base 82 and the extension 86 with the projections 828 engaging with the windows 885 of the metal shell 88, and the lower face 866 of the extension 86 engaging with the connection portions 884 of the metal shell 88.

Referring to FIG. 2, the first connector 60 is mounted on the upper surface 72 of the substrate 70 with the first terminals 64 and the grounding board locks 68 secured in the first holes of the substrate 70. The second connector 80 is mounted on the lower surface 74 of the substrate 70 with the first ends 842 of the pins 84 soldered in the second holes 78 of the substrate 70, and the board locks 886 secured in the enlarged holes 76 of the substrate 70.

Referring to FIGS. 1 and 8, the lower connector 40 is received into a receiving space 22 of the lower guide rail 20 and is mounted on the printed circuit board 50. The first connector 60 is received into the receiving space 12 of the upper guide rail 10, and the second connector 80 is received in the receiving space 22 of the lower guide rail 20 with the second ends 844 of the pins 84 being soldered to the through holes 52 of the printed circuit board 50. The lower connector 40 is also received into the receiving space 90 defined by the substrate 70 and the second connector 80. The bolts 144 extend through side lugs 142 of the upper guide rail 10 to be fastened with the fasten members 146 and the fasten members 146 extend through side lugs 242 to be soldered on the printed circuit board 50 whereby the upper and lower guide rails 10, 20 are mounted on the printed circuit board 50. Electrical signals can be transmitted from the first GBIC module through the first connector 60, the substrate 70, and the second connector 80 to the printed circuit board 50. Electrical signals can be transmitted from the second GBIC module through the lower connector 40 to the printed circuit board 50.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly, comprising:

a substrate defining upper and lower surfaces;

a first connector attached to the upper surface of the substrate; and a second connector attached to the lower surface of the substrate and electrically connected to the first connector, said second connector including a plurality of pins supported by a base and an insulative extension defining a plurality of passageways through which the pins extend respectively, each passageway of the extension being slightly larger in cross-section over most of its length than a cross-section of the corresponding pin, while also having an outlet substantially equal in cross-section to the cross-section of the pin, the outlet located at an outmost end opposite to the base and the pin snugly fitting in the outlet, one end of each pin attached to the substrate and an opposite end of each pin adapted to be connected to a printed circuit board.

2. The electrical connector assembly as recited in claim 1, wherein the second connector further comprises a metal shell enclosing the base and the extension.

3. The electrical connector assembly as recited in claim 2, wherein a plurality of board locks is integrally formed on the metal shell and secured to the substrate.

4. The electrical connector assembly as described in claim 2, wherein the base has a plurality of projections and the shell has a plurality of windows respectively engaging with the projection.

5. The electrical connector assembly as recited in claim 1, wherein the base has a pair of posts on a bottom face thereof and the extension has a pair of holes aligning with the posts and respectively receiving the posts therein.

6. The electrical connector assembly as recited in claim 1, wherein each pin 7 in its corresponding passageway is surrounded by an airspace over most of its length.

7. An electrical connector assembly, comprising:

a substrate having upper and lower surfaces;

a first connector provided on the upper surface of the substrate adapted to electrically connect with an electrical component; and a second connector attached to the lower surface of the substrate and comprising a plurality of pins supported by a base and a metal shell enclosing the base and portion of the pins not directly connected to other electrical components therein, a pair of board locks extending upwardly from sides of the metal shell securing said second connector to the substrate, first ends of the pins electrically connecting with the first connector and second ends of the pins adapted to electrically connect to a printed circuit board.

8. The electrical connector assembly as recited in claim 7, wherein the base has a plurality of projections and the shell has a plurality of windows respectively engagingly receiving the projections.

9. The electrical connector assembly as recited in claim 7, wherein the second connector further comprised an insulative extension enclosed in the metal shell and having a plurality of passageways through which the pins extend respectively.

10. The electrical connector assembly as recited in claim 7, wherein the substrate and the second connector cooperatively define a receiving space for receiving a third connector under the substrate.

11. The electrical connector assembly as recited in claim 10, wherein the third connector is vertically aligned with the first connector with a distance therebetween, the substrate is parallel to said printed circuit board in a horizontal direction, and the second connector is sandwiched between said substrate and the printed circuit board and is aligned with the third connector along said horizontal direction.

12. An electrical connector system for mounting to a printed circuit board, comprising:

an substrate having upper and lower surfaces;

a first connector provided on the upper surface of the substrate;

a second connector having a plurality of pins therein, each pin having a first end electrically mounted on the lower surface of the substrate and a second end adapted to electrically mount on the printed circuit board, the substrate and the second connector together defining a receiving space for receiving a third connector under the substrate; wherein said second connector includes a base and an extension through both of which said pins extend, and said base and said extension respectively abut against the lower surface of the substrate and a top surface of the printed circuit board.

13. The system as recited in claim 12, wherein the third connector is vertically aligned with the first connector with a distance therebetween, the substrate is parallel to said printed circuit board in a horizontal direction, and the second connector is sandwiched between said substrate and the printed circuit board and aligned with the third connector along said horizontal direction.

14. An electrical connector comprising:

an insulative base with a plurality of pins insert molded therein;

an insulative extension on which the base is seated, said extension defining a plurality of passageways through which the pins extend, respectively;

means for aligning the base and the extension together in a vertical direction;

a metal shell enclosing both said base and said extension; and an interengaging means provided on the metal shell and the base to fasten the metal shell to the base, and said extension retainably sandwiched between the base and a bottom wall of the metal shell; wherein the pins extend upwardly beyond the base and downwardly beyond the extension, respectively.

* * * * *